US011069329B2

(12) United States Patent
Eckerström

(10) Patent No.: US 11,069,329 B2
(45) Date of Patent: Jul. 20, 2021

(54) CAPO FOR ADJUSTING PITCH OF INDIVIDUAL STRINGS

(71) Applicant: Joakim Eckerström, Falun (SE)

(72) Inventor: Joakim Eckerström, Falun (SE)

(73) Assignee: Joakim Eckerström, Falun (SE)

( * ) Notice: Subject to any disclaimer, the term of this patent is extended or adjusted under 35 U.S.C. 154(b) by 0 days.

(21) Appl. No.: 16/765,822

(22) PCT Filed: Nov. 29, 2018

(86) PCT No.: PCT/SE2018/051229

§ 371 (c)(1),
(2) Date: May 20, 2020

(87) PCT Pub. No.: WO2019/108121

PCT Pub. Date: Jun. 6, 2019

(65) Prior Publication Data

US 2020/0388251 A1 Dec. 10, 2020

(30) Foreign Application Priority Data

Nov. 29, 2017 (SE) ..... 1751466-2

(51) Int. Cl.
*G10D 3/053* (2020.01)
*G10D 3/06* (2020.01)

(52) U.S. Cl.
CPC ..... *G10D 3/053* (2020.02); *G10D 3/06* (2013.01)

(58) Field of Classification Search
CPC ..... G10D 3/053
See application file for complete search history.

(56) References Cited

U.S. PATENT DOCUMENTS 652,520 A * 6/1900 Pletcher ..... G10D 3/053 84/318
1,518,719 A * 12/1924 Whiteman ..... G10D 3/053 84/318
1,616,859 A * 2/1927 Johnston ..... G10D 3/053 84/318
1,697,508 A * 1/1929 Kordick ..... G10D 3/053 84/455

(Continued)

FOREIGN PATENT DOCUMENTS

GB 2349010 A 10/2000
IT RM20140078 A1 6/2016
WO 2013112373 A1 8/2013

OTHER PUBLICATIONS

International Search Report and Written Opinion for application PCT/SE2018/051229 dated Apr. 2, 2019 (11 pages).

(Continued)

*Primary Examiner* — Robert W Horn
(74) *Attorney, Agent, or Firm* — Dinsmore & Shohl LLP

(57) ABSTRACT

A pitch adjusting device, such as a capo, and a method for adjusting the pitch for a stringed instrument that comprises a neck. The capo comprises at least one string actuating member that is an elongated member held to the capo by a biasing means such that the string actuating member extends along the extension direction of the neck when the capo is attached to the stringed instrument. The string actuating member is adjustable in a linear direction along said extension direction at the biasing means.

19 Claims, 6 Drawing Sheets

(56) References Cited

U.S. PATENT DOCUMENTS

| | | | | | |
|---|---|---|---|---|---|
| 1,785,311 | A * | 12/1930 | Johnson | G10D 3/08 | 84/317 |
| 2,604,805 | A * | 7/1952 | Haffner | G10D 3/053 | 84/318 |
| 2,669,151 | A * | 2/1954 | MacCaferri | G10D 3/08 | 84/317 |
| 4,143,576 | A * | 3/1979 | Nichols | G10D 3/053 | 84/318 |
| 4,195,546 | A | 4/1980 | Urbank | | |
| 4,926,732 | A | 5/1990 | Collins et al. | | |
| 5,431,080 | A * | 7/1995 | Wiesenthal | G10D 3/053 | 84/318 |
| 6,107,554 | A * | 8/2000 | Riddle | G10D 3/053 | 84/300 |
| 6,521,820 | B1 * | 2/2003 | Patel | G10D 3/053 | 84/318 |
| 7,511,208 | B1 * | 3/2009 | Kyser | G10D 3/053 | 84/318 |
| 7,557,285 | B2 * | 7/2009 | Ward | G10D 3/053 | 84/422.1 |
| 7,956,263 | B1 * | 6/2011 | Volk, Jr. | G10D 3/053 | 84/318 |
| 8,618,389 | B2 * | 12/2013 | Ryan | G10D 3/053 | 84/318 |
| 9,257,102 | B2 * | 2/2016 | Ryan | G10D 3/053 | |
| 9,424,817 | B2 * | 8/2016 | Ryan | G10D 3/053 | |
| 10,839,775 | B2 * | 11/2020 | McClary | G10D 3/053 | |
| 2020/0388251 | A1 * | 12/2020 | Eckerstrom | G10D 3/053 | |

OTHER PUBLICATIONS

Swedish office action for application 1751466-2 dated Jun. 7, 2018 (8 pages).

* cited by examiner

CAPO FOR ADJUSTING PITCH OF INDIVIDUAL STRINGS

CROSS-REFERENCE TO RELATED APPLICATIONS

The present application is a National Phase Entry of International Application No. PCT/SE2018/051229, entitled "CAPO FOR ADJUSTING PITCH OF INDIVIDUAL STRINGS" and filed on Nov. 29, 2018, which claims priority to Swedish Patent Application No. 1751466-2 filed with the Swedish Patent Office on Nov. 29, 2017 and entitled "CAPO FOR ADJUSTING PITCH OF INDIVIDUAL STRINGS", the entire contents of both are incorporated herein by reference.

TECHNICAL FIELD

The present invention relates generally to a device, namely a capo, for adjusting the pitch of individual strings of a musical stringed instrument.

BACKGROUND ART

In prior art, a capo is a device for adjusting the pitch of strings on a stringed instrument through shortening the playable length of the strings. The most common solution is a bar that is clamped to the neck of a stringed instrument wherein the bar has a rubber cover that actuate the strings towards any one of the front side of the neck, a finger board, or a fretboard. Through reducing the playable length of the strings, the capo temporarily replaces part of the functionality of the nut and thereby raising the pitch. The capo is used by musicians as a tool to play stringed instrument in different key without retuning the instrument. The capo further enables the musician to quickly change between different key using the same fingerings as if playing the instrument open, i.e. without a capo.

SUMMARY OF INVENTION

Most capo designs are adapted to actuate all strings of the stringed instrument simultaneously through pressing them towards for example a fretboard at the same fret. The capo is thereby used to transpose the open notes of the instrument upwards. Temporarily changing the key of the instrument through transposing the notes is useful, however, for more advanced playing it would be beneficial with a capo that provides more flexibility and that enables actuation of single strings individually.

The inventor has during the development realized that attempts has been made to overcome at least some of the drawbacks with the traditional capo. For example, solutions being glued or fastened with adhesive tape to a guitar and capos adapted to actuate only some strings of a specific fret has been examined as well as solutions for actuating specific strings on one or a few frets on for example a guitar. However, there is a need for a rigid capo providing flexibility for the musician meanwhile maintaining the ease of use associated with a traditional capo.

An object is to provide a capo that is adapted to adjust the pitch of individual strings of a stringed instrument.

Another object is to provide a capo that is adapted to actuate individual strings at different distances from the nut of a stringed instrument.

Another object is to provide a capo that enables individual transposing of open notes for the strings of a stringed instrument.

An object is to make the capo easy to adjust and that is adjustable also during a song.

Another object is to provide a capo that doesn't limit the musicians access to the strings.

Another object is to provide a capo that can be mounted above the nut, i.e on the side of the nut wherein the head of the stringed instrument is located.

Yet another object is to provide a capo that can adjust the pitch of strings at difference distances from the nut without releasing the attachment of the capo from the stringed instrument.

A further object is to provide a capo that can actuate strings at a position that is not adjacent to the capo.

Accordingly, the present invention preferably seeks to mitigate, alleviate or eliminate one or more of the above-identified deficiencies in the art and disadvantages singly or in any combination and solves at least the abovementioned problems by providing a pitch adjusting device, such as a capo, for attachment to a stringed instrument that comprises a neck. The capo comprises at least one string actuating member that is an elongated member held to the capo by a biasing means such that the string actuating member extends along the extension direction of the neck when the capo is attached to the stringed instrument. The string actuating member is adjustable in a linear direction along said extension direction at the biasing means.

According to one embodiment the string actuating member, when actuated, applies a pressure to a specific string in the direction towards any one of the front side of the neck, fret board, or finger board of the stringed instrument.

According to one embodiment the string actuating member, when actuated, applies a pressure to a specific string in a direction that is substantially perpendicular to the extension direction of the neck.

According to one embodiment the string actuating member has a length between 10 cm and 25 cm.

According to one embodiment the string actuating member has a length between 12 cm and 25 cm.

According to one embodiment the string actuating member has a length between 15 cm and 25 cm.

According to one embodiment the string actuating member has a length between 15 cm and 20 cm.

According to one embodiment the string actuating member is longer than any one of 10 cm, 15 cm, 20 cm, and 30 cm.

According to one embodiment the string actuating member is longer than 12 cm.

According to one embodiment of the capo the string actuating member is adapted to reduce the playable length of a specific string through actuating said string against any one of a fretboard, finger board, neck, and the front side of the neck.

According to one embodiment the capo further comprises an attachment means for securing the capo to the stringed instrument. It is one advantage with the present solution that the attachment means for securing the capo to the stringed instrument and the biasing means securing the string actuating member are actuated separately.

In different embodiments, the capo could be attached for example to the neck or the head of the stringed instrument but as understood by the person skilled in the art there are many different solutions for attaching the capo to the stringed instrument, some conventional as known in the art and some as described herein. In one embodiment the capo is attached to the head of the stringed instrument in the close vicinity of the nut by means of the attachment means. In another embodiment the capo is attached to the neck of the stringed instrument by means of the attachment means.

It is further one advantage that the string actuating member is an elongated member extending from or through the biasing means of the capo and thereby extends such that strings can be actuated although the capo is attached to for example the head of the stringed instrument. By actuating the strings at another position than the where the attachment means of the capo is arranged provides better access to the remaining strings.

According to one embodiment the string actuating member is adapted to actuate a string at a position that is more than any one of 1 cm, 2 cm, 3 cm, or 4 cm from the attachment means of the capo.

According to one embodiment the string actuating member is adapted to actuate a string at a position that is more than 5 cm from the attachment means of the capo.

According to one embodiment the biasing means is adapted, or arranged, to be actuated between a first position biasing the string actuating member towards a string of the stringed instrument and a second position wherein the string actuating member is adjustable without any tension at the biasing means.

According to another embodiment of the capo the biasing means is adapted to be actuated between a locked position biasing the string actuating member towards a string of the stringed instrument and an unlocked position wherein the string actuating member is adjustable.

In different embodiments of the capo the biasing means have different means for actuating the string actuating member. In one embodiment a spring element, such as a torsion, compression, extension spring, is used to place the string actuating member in a state of tension between the biasing means and the string. In another embodiment, the biasing means has a built in biasing effect, such as a torsion spring. In yet another embodiment the biasing means comprises an elastic member, such as a rubber band or a rubber member, biasing the string actuating member towards the string. The biasing means thereby is the arrangement holding the string actuating member to the capo and that provides a tension effect pressing the string actuating member towards a string.

According to one embodiment the string actuating member is adjustable at the biasing means without releasing the capo from the stringed instrument.

According to one embodiment the string actuating member is adjustable at the biasing means without releasing the capo from any one of the neck, the head, the fretboard, or a location above the nut of the stringed instrument.

According to one embodiment the string actuating member is a telescopic member.

According to one embodiment the telescopic member is adjustable in a linear direction to enable actuation of a string at different positions.

According to one embodiment the biasing means is adapted to secure the string actuating member to the capo.

According to one embodiment the biasing means are further adapted to lock the telescopic function of a telescopic string actuating member.

According to one embodiment the string actuating member is biased towards the string by a spring element.

According to one embodiment the string actuating member is adjustable in a linear direction along the extension direction of the neck through replacing the string actuating member with a longer or shorter string actuating member.

According to one embodiment the capo is adapted to be attached above the nut of the stringed instrument.

According to one embodiment the attachment means is adapted to bias the string actuating member towards a string of the stringed instrument.

According to one embodiment the capo comprises at least three string actuating members.

According to one embodiment the string actuating member comprises a string holding means for a single string.

The string holding means can in different embodiments be different sorts of string holding means preventing that the string actuating means slides of the string. Examples are a slit in the string actuating means, a rubber coating, a rubber element, or any other form of suitable means.

According to one embodiment the capo comprises multiple string actuating members, each associated with one string of a stringed instrument, and wherein each string actuating member is separately adjustable along the length of the string.

According to one embodiment the capo comprises the same number of string actuating members as the number of strings on the stringed instrument.

According to one embodiment the capo is part of the stringed instrument.

In one embodiment the capo is constructed as being part of a stringed instrument, for example being part of the neck or head of the instrument.

In one embodiment the string actuating member actuates strings in more than one direction from the biasing means. In such an embodiment the capo might be arranged in a position on the neck allowing actuation of strings at any one or more of the following positions, below the capo, above the capo, or beneath the capo.

BRIEF DESCRIPTION OF DRAWINGS

The invention is now described, by way of example, with reference to the accompanying drawings, in which.

DESCRIPTION OF EMBODIMENTS

In the following, a detailed description of the different embodiments of the solution is disclosed under reference to the accompanying drawings. All examples herein should be seen as part of the general description and are therefore possible to combine in any way of general terms. Individual features of the various embodiments and aspects may be combined or exchanged unless such combination or exchange is clearly contradictory to the overall function of the capo.

Briefly described the solution relates to a capo adapted to be attached to a stringed instrument, wherein the capo comprises at least one string actuating member that may adjust the pitch of a specific string through pressing it towards any one of a fretboard, a finger board, or the front side of the neck of the stringed instrument. The string actuating member is attached to the capo by a biasing means enabling the string actuating member to be adjusted without removing or releasing the attachment of the capo from the stringed instrument.

Figure 1:
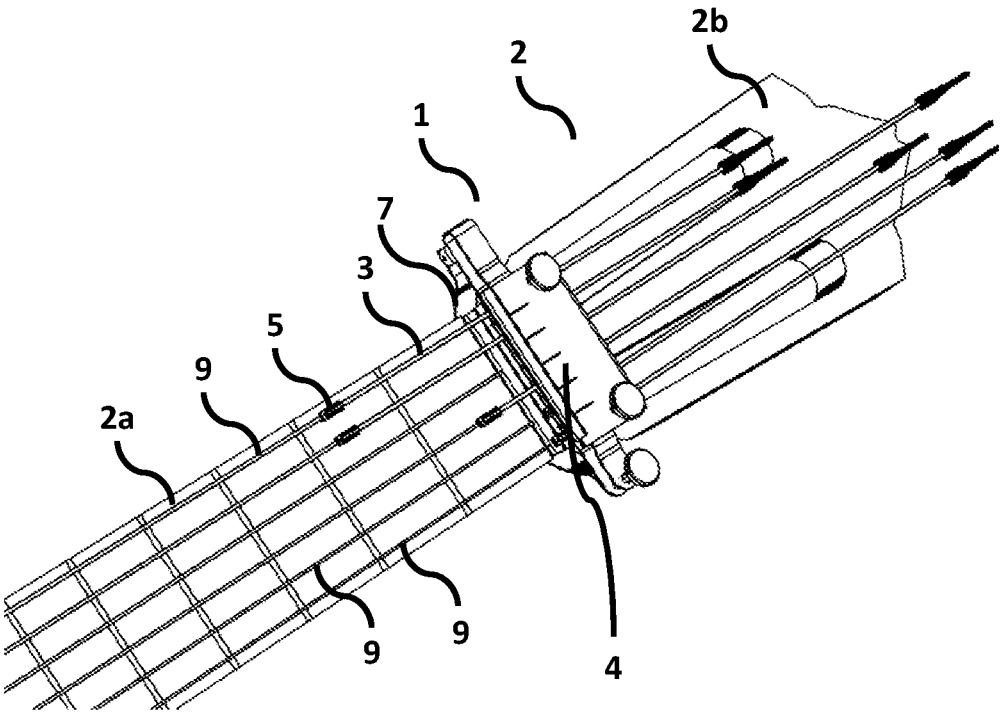
FIG. 1 illustrates one embodiment of the capo attached to a stringed instrument.

FIG. 1 illustrates a capo 1 attached to the head 2*b* of a stringed instrument 2. In this particular illustration the stringed instrument 2 is a guitar with six strings 9. However, the capo 1 as described herein can be used with other types of stringed instruments 2. The capo 1 has at least one, or as illustrated in FIG. 1 three string actuating members 3 extending through a biasing means 4 along the extension direction of the neck 2*a*. The extension direction of the neck 2*a* as described herein is a bidirectional direction, however, it shall be noted that the string actuating members 3 only actuates strings in one direction from the biasing means 4 as shown in FIG. 1. The string actuating members 3 are elongated members biased towards the strings by means of the biasing means 4. In the embodiment as illustrated in FIG. 1 the biasing means 4 is a material with openings allowing individual biasing of the string actuating members 3. However, different form of biasing means 4, with or without one or more spring members, may be used in different embodiments as described herein and illustrated in the set of figures. As illustrated in FIG. 1 the capo 1 is arranged above the nut of the stringed instrument 2 in some embodiments.

The string actuating member 3 further comprises a string holding means 5 at the end of the string actuating member 3. The string holding means 5 is adapted to ensure that the string actuating member 3 holds the string securely and can for example be a rubber case around the string actuating member 3 or a slot in the string actuating member 3 securing the string 9.

As further shown in FIG. 1 it is one advantage with the present solution that the string actuating members 3 don't block the access to other strings on the stringed instrument 2. Thereby, it is possible to play strings currently not actuated by a string actuating member 3 all the way to the nut or to the first fret of the fretboard (if the stringed instrument has a fretboard) without interference with the capo 1. This is further enabled by the capo 1 in some embodiments being arranged above the nut of the stringed instrument 2.

As previously stated, the stringed instrument 2 as illustrated in FIG. 1 is a guitar but the stringed instrument 2 could be any other form of instrument utilizing vibrating strings, such as a twelve-stringed guitar, a violin, a cello, banjo, mandolin, ukulele, or similar.

Figure 2:
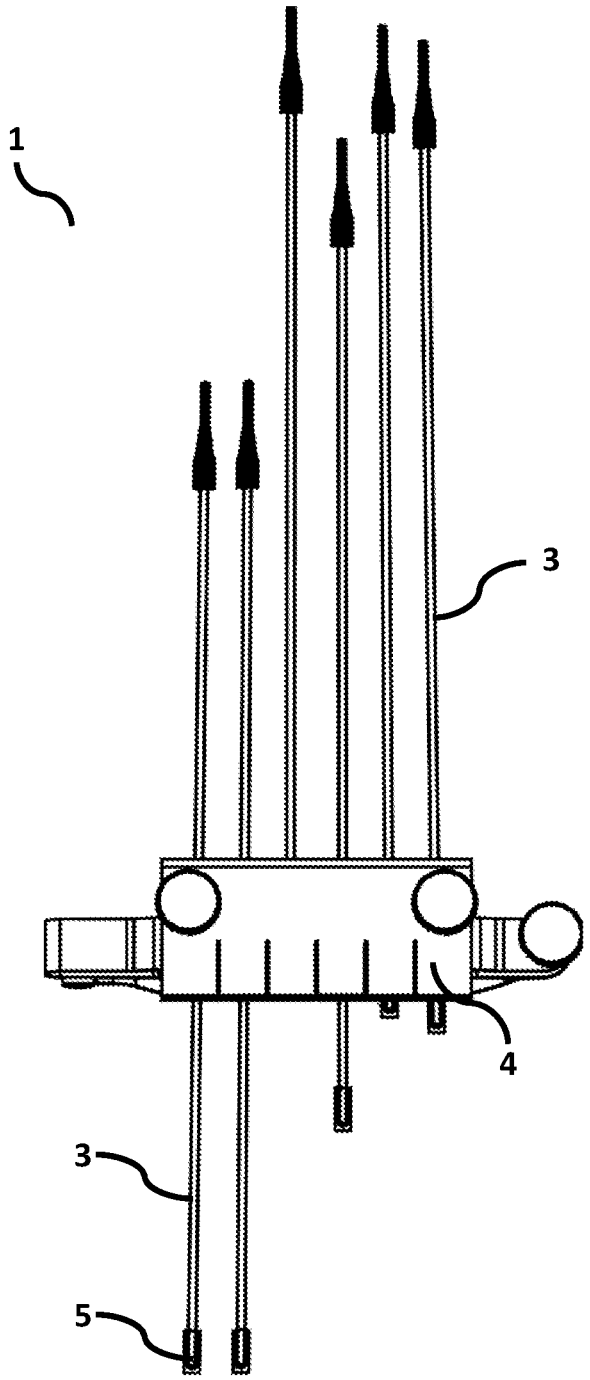
FIG. 2 illustrates one embodiment of the capo.

FIG. 2 illustrates the embodiment of the capo 1 as shown in FIG. 1, however in FIG. 2 the capo 1 isn't attached to a stringed instrument 2.

Figure 3:
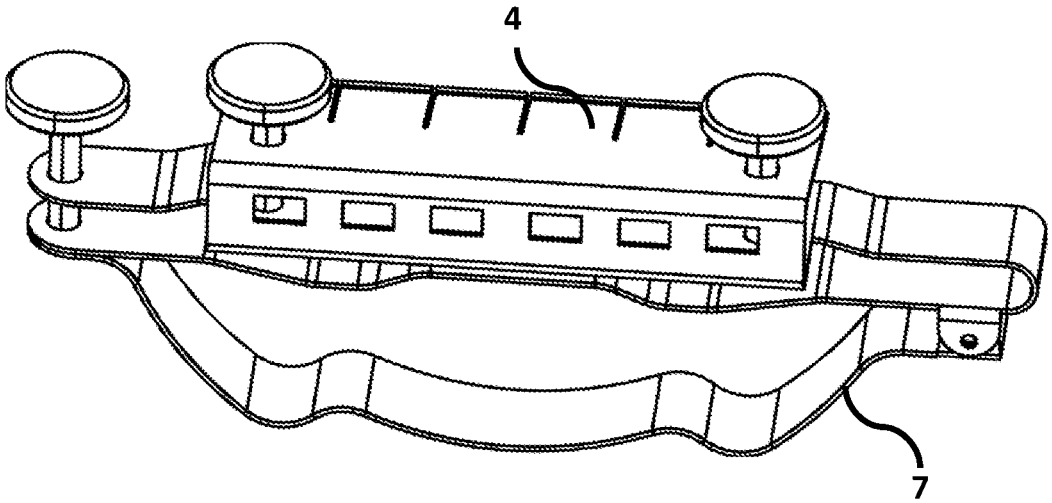
FIG. 3 illustrates one embodiment of the attachment means and the biasing means of the capo.

FIG. 3 illustrates one embodiment of an attachment means 7 and a biasing means 4 of a capo 1. It shall be noted that many different sorts of attachment means 7 can be used to attach the capo 1 to a stringed instrument 2.

Figure 4:
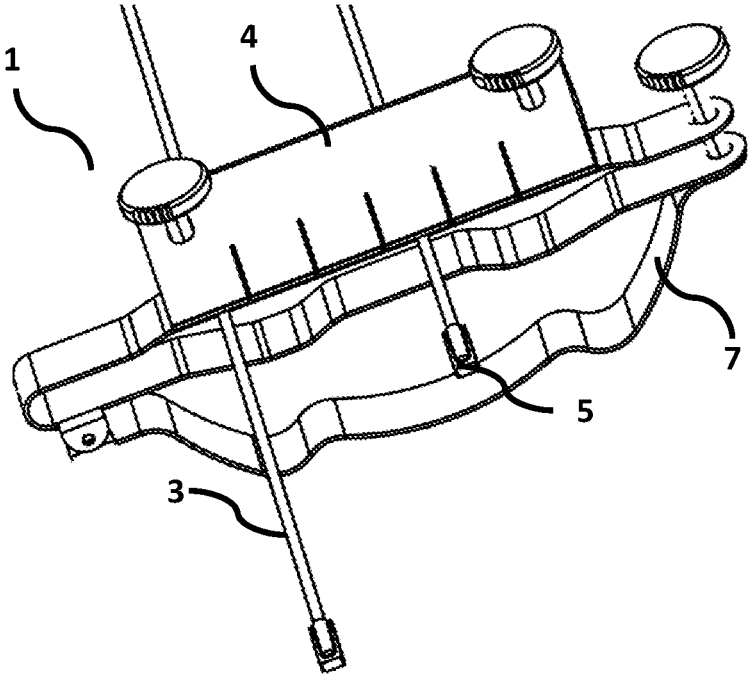
FIG. 4 illustrates one embodiment of a capo with two string actuating members extending through the biasing means.

FIG. 4 illustrates one embodiment of the capo 1 with two string actuating members 3 extending through the biasing means 4.

FIG. 1-4 further illustrates parts that in some embodiments are parts of the capo 1, such as screws enabling adjustment of the tension created by the biasing means 4.

Figure 5:
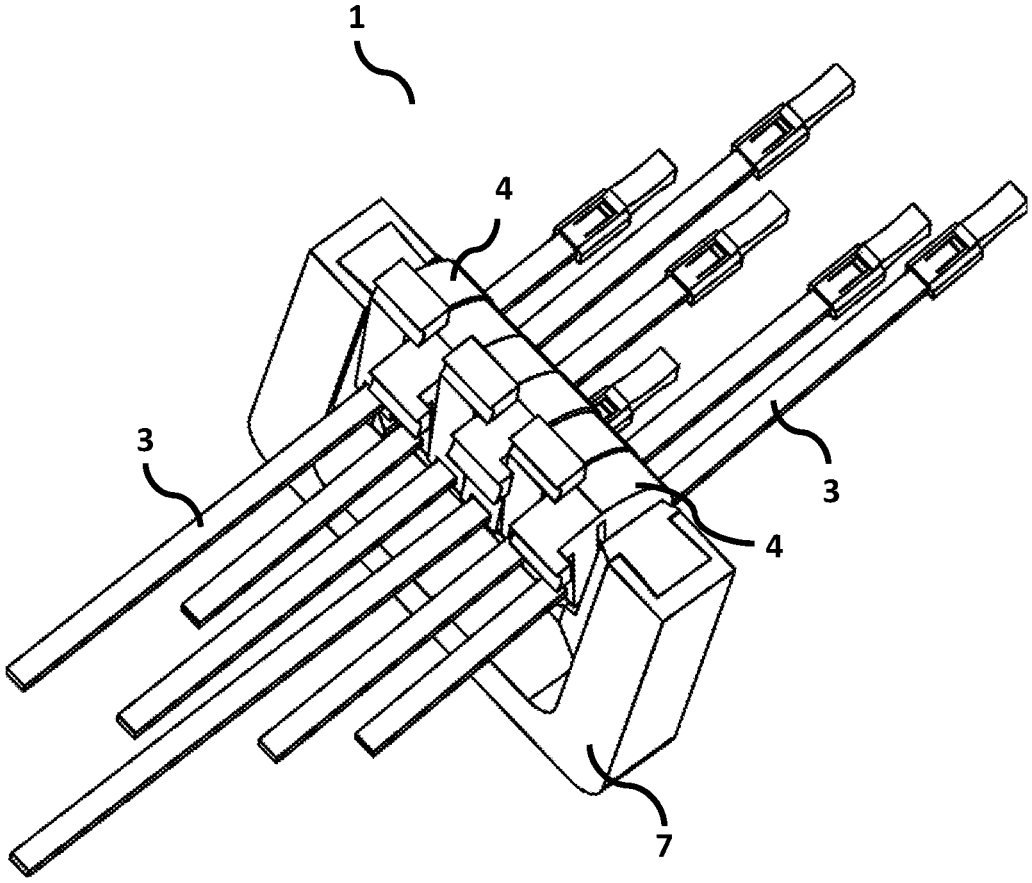
FIG. 5 illustrates another embodiment of a capo with six string actuating members.

FIG. 5 illustrates one embodiment of the capo 1 comprising multiple string actuating members 3 extending through biasing means 4. The biasing means 4 are in the embodiment as illustrated in FIG. 5 rotatably arranged around an axis 6 (as shown in FIG. 6) and adapted to bias the string actuating members 3 separately towards a string 9 of a stringed instrument 2.

Figure 6:
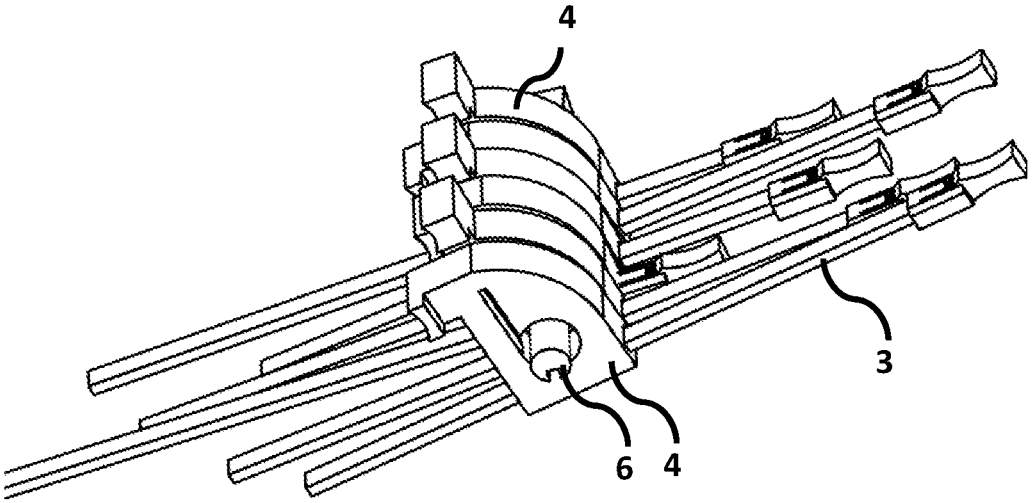
FIG. 6 illustrates one embodiment of biasing means and string actuating members of a capo.

FIG. 6 illustrates one embodiment of the biasing means 4 from the embodiment as illustrated in FIG. 5 and the axis 6 enabling the biasing means 4 to be rotatably arranged.

Figure 7A:
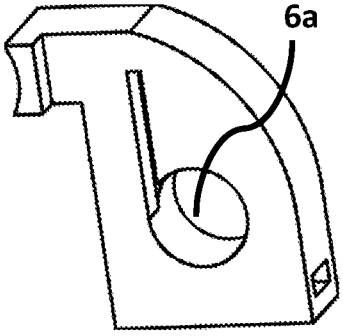
FIG. 7*a* illustrates one embodiment of a biasing means of the capo.

FIG. 7*a* illustrate one embodiment of part of the biasing means 4 with an opening 6*a* adapted to receive the axis 6 (as illustrated in FIG. 6). FIG. 7*a* further illustrates how the opening 6*a* has a slit adapted to receive part of a spring member that in some embodiments enables the biasing means 4 to bias a string actuating member 3 towards a string 9 of a stringed instrument 2.

Figure 7B:
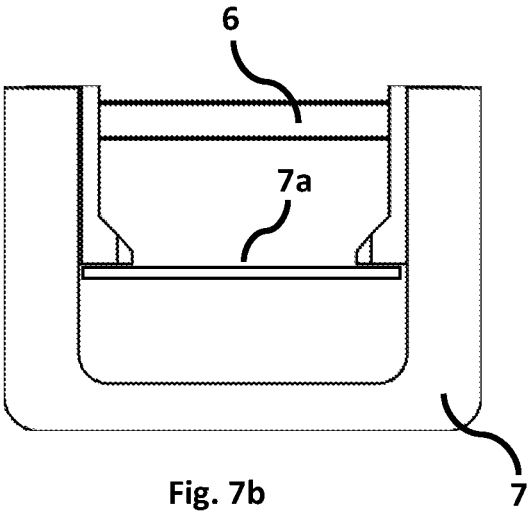
FIG. 7*b* illustrates one embodiment of an attachment means of the capo.

FIG. 7*b* illustrates one embodiment of parts of a capo 1, there among the attachment means 7. In some embodiments, the attachment means 7 may further comprise an attachment plate 7*a* distributing the load over the neck 2*a* of a stringed instrument 2 to reduce the risk of damaging the instrument.

Figure 8:
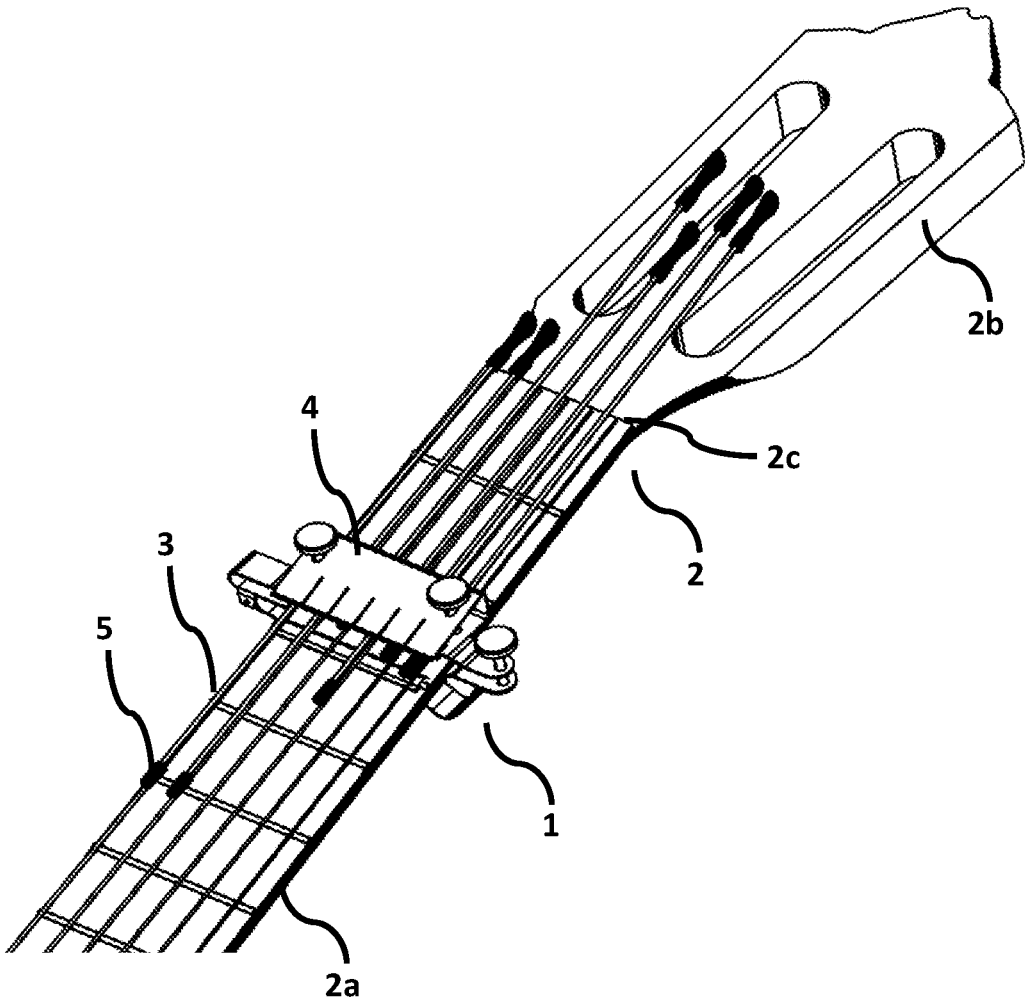
FIG. 8 illustrates one embodiment of a capo attached to a stringed instrument.

FIG. 8 illustrates one embodiment of a capo 1, wherein the capo 1 is arranged on the neck 2*a* of the stringed instrument 2. FIG. 8 further illustrates how the capo 1 is arranged below the nut 2*c* in contrary to for example FIG. 1 wherein the capo 1 is arranged above the nut 2*c*.

The invention claimed is:

1. A capo for attachment to a neck or a head of a stringed instrument, wherein the capo is configured to be equipped with a plurality of string actuating members, wherein each string actuating member is associated with one string of the stringed instrument, wherein the string actuating member is an elongated member held to the capo by a biasing means such that said string actuating member extends through the biasing means and along an extension direction of the neck when the capo is attached to the stringed instrument, wherein said string actuating member is adjustable in a linear direction along said extension direction of the neck at the biasing means, wherein each string actuating member is separately adjustable along the length of the string, wherein the string actuating member is biased, at the biasing means, towards the string by a spring element or an elastic member, and wherein the string actuating member is adjustable at the biasing means without releasing the capo from the stringed instrument.

2. The capo of claim 1, wherein the string actuating member is adapted to reduce the playable length of a specific string through actuating said string against any one of a fretboard, a finger board, and the front side of the neck.

3. The capo of claim 1, wherein the string actuating member is longer than 12 cm.

4. The capo of claim 1, wherein the string actuating member is extending from the biasing means and actuating a string at least 10 cm from said biasing means.

5. The capo of claim 1, wherein the capo further comprises an attachment means for securing the capo to the stringed instrument.

6. The capo of claim 1, wherein the biasing means is adapted to be actuated between a first position biasing the string actuating member towards a string of the stringed instrument and a second position wherein the string actuating member is adjustable without any tension at the biasing means.

7. The capo of claim 1, wherein the string actuating member is adjustable at the biasing means without releasing the attachment means of the capo from the stringed instrument.

8. The capo of claim 1, wherein the spring element is a torsion, compression or extension spring, and is used to place the string actuating member in a state of tension between the biasing means and the string.

9. The capo of claim 1, wherein said capo is adapted to be attached above the nut of the stringed instrument.

10. The capo of claim 1, wherein the biasing means is adapted to bias the string actuating member towards a string of the stringed instrument.

11. The capo of claim 1, wherein the capo comprises at least three string actuating members.

12. The capo of claim 1, wherein the string actuating member comprises a string holding means adapted to abut a single string.

13. The capo of claim 1, wherein said capo comprises multiple string actuating members, each associated with one string of the stringed instrument, and wherein each string actuating member is separately adjustable at the biasing means along the direction of the length of the string.

14. The capo of claim 1, wherein the capo comprises the same number of string actuating members as the number of strings on the stringed instrument.

15. The capo of claim 1, wherein the capo is part of the stringed instrument.

16. The capo of claim 8, wherein the biasing means is a torsion spring.

17. The capo of claim 1, wherein the attachment means may further comprise an attachment plate distributing the load over the neck of a stringed instrument.

18. The capo of claim 1, wherein capo is arranged to be attached to any of the neck, above the nut or to the head of the stringed instrument.

19. A guitar, comprising:

a neck;

a head; and a capo attached to the neck or the head, the capo is configured to be equipped with a plurality of string actuating members, wherein each string actuating member is associated with one string of the guitar, wherein the string actuating member is an elongated member held to the capo by a biasing means such that said string actuating member extends through the biasing means and along an extension direction of the neck when the capo is attached to the stringed instrument, wherein said string actuating member is adjustable in a linear direction along said extension direction of the neck at the biasing means, wherein each string actuating member is separately adjustable along the length of the string wherein the string actuating member is biased, at the biasing means, towards the string by a spring element or an elastic member, and wherein the string actuating member is adjustable at the biasing means without releasing the capo from the stringed instrument.

* * * * *